US011213965B2

(12) United States Patent
Jusidman et al.

(10) Patent No.: US 11,213,965 B2
(45) Date of Patent: Jan. 4, 2022

(54) AXE COVER WITH SNAPPING MECHANISM

(71) Applicant: Truper, S.A. de C.V., Estado de Mexico (MX)

(72) Inventors: Arie Jusidman, Mexico City (MX); Jose Gamboa, Roswell, GA (US); Mark Dorenkott, Westlake, OH (US)

(73) Assignee: Truper, S. A. de C.V., Jilotepec (MX)

( * ) Notice: Subject to any disclaimer, the term of this patent is extended or adjusted under 35 U.S.C. 154(b) by 0 days.

(21) Appl. No.: 16/890,610

(22) Filed: Jun. 2, 2020

(65) Prior Publication Data

US 2021/0370536 A1 Dec. 2, 2021

(51) Int. Cl.

| | |
|---|---|
| ***B26B 29/00*** | (2006.01) |
| ***B25H 3/00*** | (2006.01) |
| ***A45F 5/14*** | (2006.01) |
| *B26B 23/00* | (2006.01) |

(52) U.S. Cl.

CPC ..... *B26B 29/00* (2013.01); *B25H 3/00* (2013.01); *A45F 5/14* (2013.01); *B26B 23/00* (2013.01)

(58) Field of Classification Search

CPC ..... B26B 29/00; B26B 23/00; B25H 3/00; A45F 5/14; B27G 19/02

USPC ..... 206/349

See application file for complete search history.

(56) References Cited

U.S. PATENT DOCUMENTS

| | | | |
|---|---|---|---|
| 2,565,680 | A | 8/1951 | Field |
| 4,621,753 | A | 11/1986 | Ridlings |
| 5,248,072 | A | 9/1993 | Jones |
| 5,465,889 | A | 11/1995 | Smith |
| 5,568,889 | A | 10/1996 | Hollowat, Jr. et al. |
| 2016/0303731 | A1 | 10/2016 | Barlow |

(Continued)

FOREIGN PATENT DOCUMENTS

| | | | |
|---|---|---|---|
| CN | 202825880 | U | 3/2013 |
| CN | 203665560 | U | 6/2014 |

(Continued)

OTHER PUBLICATIONS

X15 Chopping Axe, X27 Super Splitting Axe, X11 Splitting Axe, and X25 Splitting Axe sold by Fiskars (https://www.fiskars.com/en-us/search-results-page?searchterm=AXE). Website accessed Sep. 10, 2020. Products shown are admitted prior art.

(Continued)

*Primary Examiner* — Rafael A Ortiz

*Assistant Examiner* — Sanjidul Islam

(74) *Attorney, Agent, or Firm* — Polson IP Law, PC; Margaret Polson

(57) ABSTRACT

The present invention consists of a safety protective cover for cutting tool head having a protective housing fitted to receive a shape of the cutting tool and the rear portion has a locking mechanism fitted to be inserted inside a hole of the cutting tool. The locking mechanism has at least two locking arms capped at their end by a notch extending outwardly away from the other arm, and each arm comprises at least one rib on the inner surface thereof; and, further, the locking mechanism has a first side opening, a second side opening, a stop opening and a central opening; and has at least one rim on the inner surface of the central opening.

9 Claims, 10 Drawing Sheets

(56) References Cited

U.S. PATENT DOCUMENTS

| | | | | |
|---|---|---|---|---|
| 2016/0361812 | A1 | 12/2016 | Cason, IV | |
| 2020/0008561 | A1* | 1/2020 | Romang | A62C 8/00 |

FOREIGN PATENT DOCUMENTS

| | | | |
|---|---|---|---|
| CN | 205394478 | U | 7/2016 |
| TW | 250739 | U | 7/1995 |

OTHER PUBLICATIONS

Pending US design U.S. Appl. No. 29/706,062, filed Sep. 17, 2019, applicant Truper, S.A. de C.V. Per rule 609.07, copy not provided as this is available in the USPTO system.

* cited by examiner

AXE COVER WITH SNAPPING MECHANISM

TECHNICAL FIELD OF THE INVENTION

The present invention refers to the technical field of cutting tools packaging. Particularly, this invention consists of a safety cover to protect the head of a hand cutting tool, in order to maintain the safety during the transportation, display thereof on store shelves.

BACKGROUND OF THE INVENTION

Currently the offerings in the market are a diverse plurality of hand tools, particularly cutting tools such as axes, picks, among others. During transportation, thereof, it is important to be careful with cutting or sharp parts of the heads of said tools.

Likewise, it is important to keep on being careful when the tools are displayed in both specialty stores and common stores, such as department stores or supermarkets. For example, this type of common shops is visited by all kinds of people, including children or seniors. Therefore, it is important to ensure the safeguarding of the sharp edges of cutting tools while they are displayed on shelves. To address this problem, some of the tools have protective packaging in the sharp edges and which ease the hanging tasks for the display thereof.

The prior art shows an example of a tool that can be hung for display or transportation as is described in US patent application US20160361812A1, which cites a multi tool with tool handle and head which can be hung in by an anchoring hook that adapts to a display or to the user. However, this invention is limited only to hanging the tool and does not provide any protection whatsoever from the sharp edge to the user either during transport or display of the tool.

Now, further considering the protection function, in the prior art there exist axe covers or cases manufactured of leather, fabric or plastic, which serve to wrap the cutting edge or edges of an axe head. Said covers are usually fastened with a strap of the same material and/or by a button or lock. In some cases, these covers can be fitted into the user's belt for transportation of the axe. However, this type of covers have existed for several decades now and can be an expensive or luxurious solution. In addition, the vast majority of these covers are generic and are not always correctly suited to all the shapes of the axes. Moreover, in any of these covers, an accidental opening of the strap or lock may occur thereby unintentionally uncovering the sharp edge of the axe. Patents U.S. Pat. Nos. 2,565,680, 4,621,753, 5,248,072, 5,465,889, 5,568,889 and utility model TW250739U may be cited as examples of this type of covers or cases.

In this regard, there are some other patent documents relating to protective covers for cutting tools. For example, utility model CN202825880U describes nighttime axe covered with a fluorescent layer, comprising an axe head, an axe handle with telescopic structure and a rubber protective sleeve. The protective sleeve allows preventing accidents with the sharp of the axe, but has no support or adjustment means, so it can be easily removable.

Additionally, US patent application US20160303731A1 describes a hand tool and a retainer cover, wherein the cover holds a pair of handles of the hand tool in a storage position. The retainer cover is manually adjusted to the hand tool when a user places the hand tool in a storage position. At least one of the handles includes a latch member for securing the retainer to the tool. The latch member includes a button that is exposed through an opening in the cover when the tool is retained in storage position. When the user presses the button, the hand tool is manually released from the retainer cover. The main disadvantage of this application is that it works with hand tools having at least two handles, being limited only to scissors or clamps. Another disadvantage is that the cover does not protect the user from the sharp edge of the tool. Finally, the mechanism and release button are elements which may increase the cost of a cover.

Now then, on its part, utility model CN205394478U discloses a hanging protective cover for an axe comprised by the contour of the ax head that matches said ax head. Furthermore, the cover has grooves matching the axe head and handle, and an anchor ring. The head groove is provided on both sides, respectively, with an axe blade locating and a rear resilient fastener of the axe, while the groove of the handle of the axe has resilient flanges. The cover as a whole can cushion a fall of the tool, reduce the power of an impact and improves the function of protection, safety, practicality and has an elegant appearance. However, the main disadvantage of this axe cover is that the contour of the head wraps the head but lacks any fastening element.

Finally, utility model CN203665560U describes an insertion-type safety axe head cover comprising a body provided with an inwards-concave cavity, wherein the shape and size of the cavity match those of the axe head. The axe can be placed in the cavity from one end of the cavity, while the other end of the cavity is provided with an end wall and an opening suitable for a helve to stretch out in the end wall is formed. The cavity further comprises two side walls and a bottom wall, at least two elastic pieces used for supporting the axe are arranged on the bottom wall, at least one blocking piece facing towards the interior of the cavity is arranged at the top end of each side wall, and at least one blocking piece facing towards the interior of the cavity is also arranged at the top end of the end wall. The entirety of the axe head can be set in the axe safety cover, the sharp of the axe is not exposed. Therefore, the axe can be more safely transported and stored. Meanwhile, the insertion-type safety axe cover is suitable for transportation and storage. This invention has the disadvantage that although the cover protects the sharp edge of the axe and allows hanging the cover, it is true that it lacks a fastening element.

So, there exists the need in the prior art of having safety covers that allow protecting the sharp edges of cutting tools to avoid any kind of accident during the transportation and display thereof. Also, there is the need for this type of protective covers to ease the hanging packaging functions to display the product. Finally, it is important for such cover to include snapping mechanisms to prevent the protective cover from being easily or accidentally removed.

OBJECTS OF THE INVENTION

The main object of the present invention is to provide a safety protective cover for the sharp edges of cutting hand tools during the transportation, and display thereof.

Another object of the present invention refers to the safety protective cover working as a hanging packaging for displaying the cutting tool.

A further object of this invention refers to the protective cover further including a snapping mechanism to prevent an accidental or inadvertent opening.

BRIEF DESCRIPTION OF THE FIGURES

To provide a better understanding of the invention, the following drawings are appended.

DETAILED DESCRIPTION OF THE INVENTION

Figure 1:
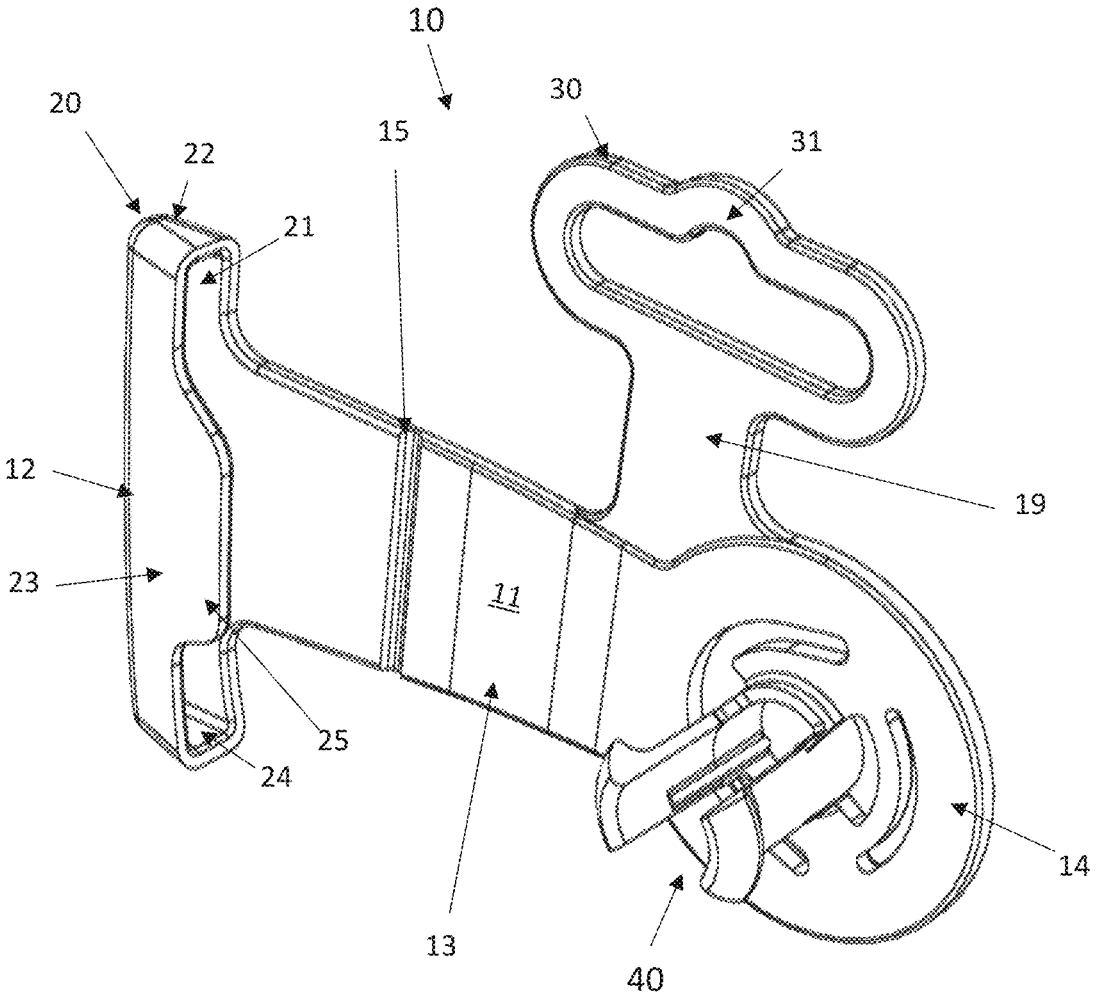
FIG. 1 refers to a right front top perspective view of a first embodiment of the safety protective cover for cutting tool head object of the present invention.
Figure 2:
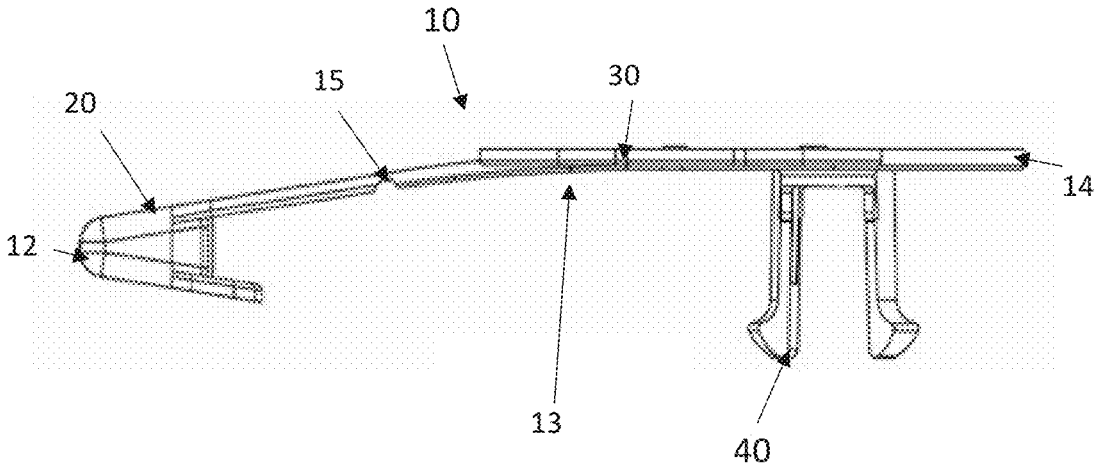
FIG. 2 refers to a top view of the embodiment of the safety protective cover of FIG. 1.
Figure 3:
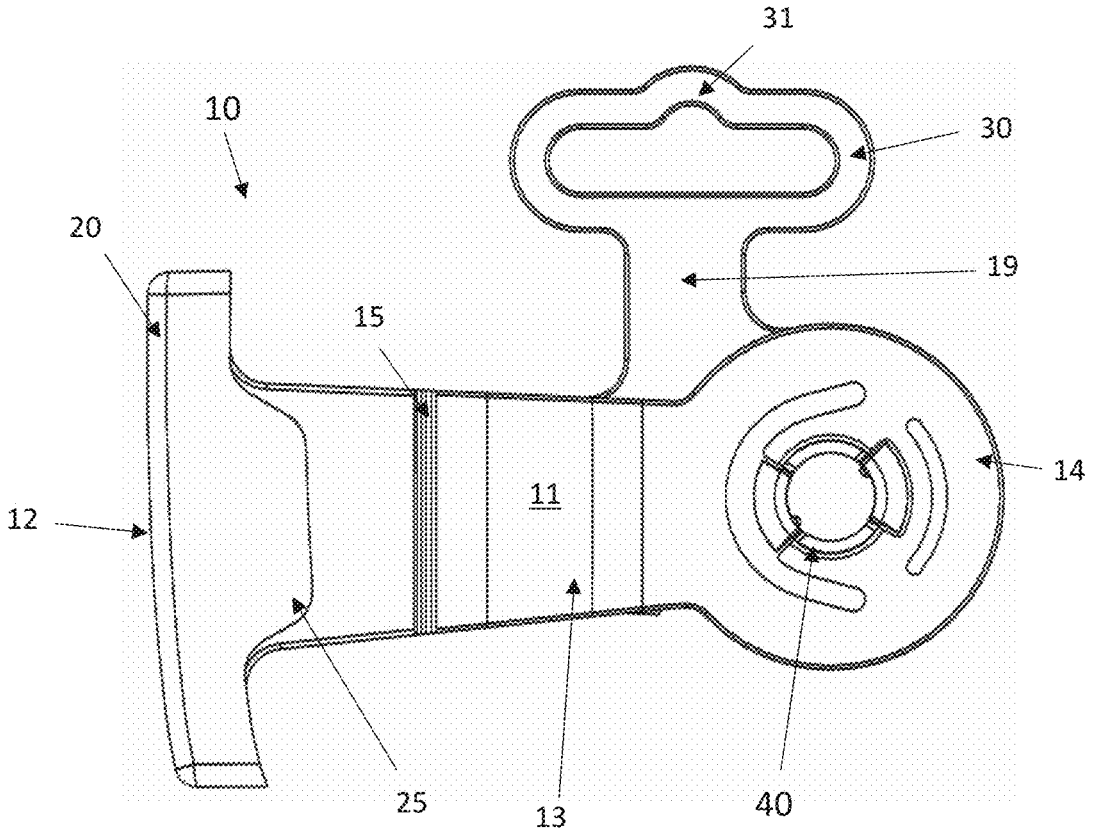
FIG. 3 refers to a front view of the embodiment of the safety protective cover of FIG. 1.
Figure 4:
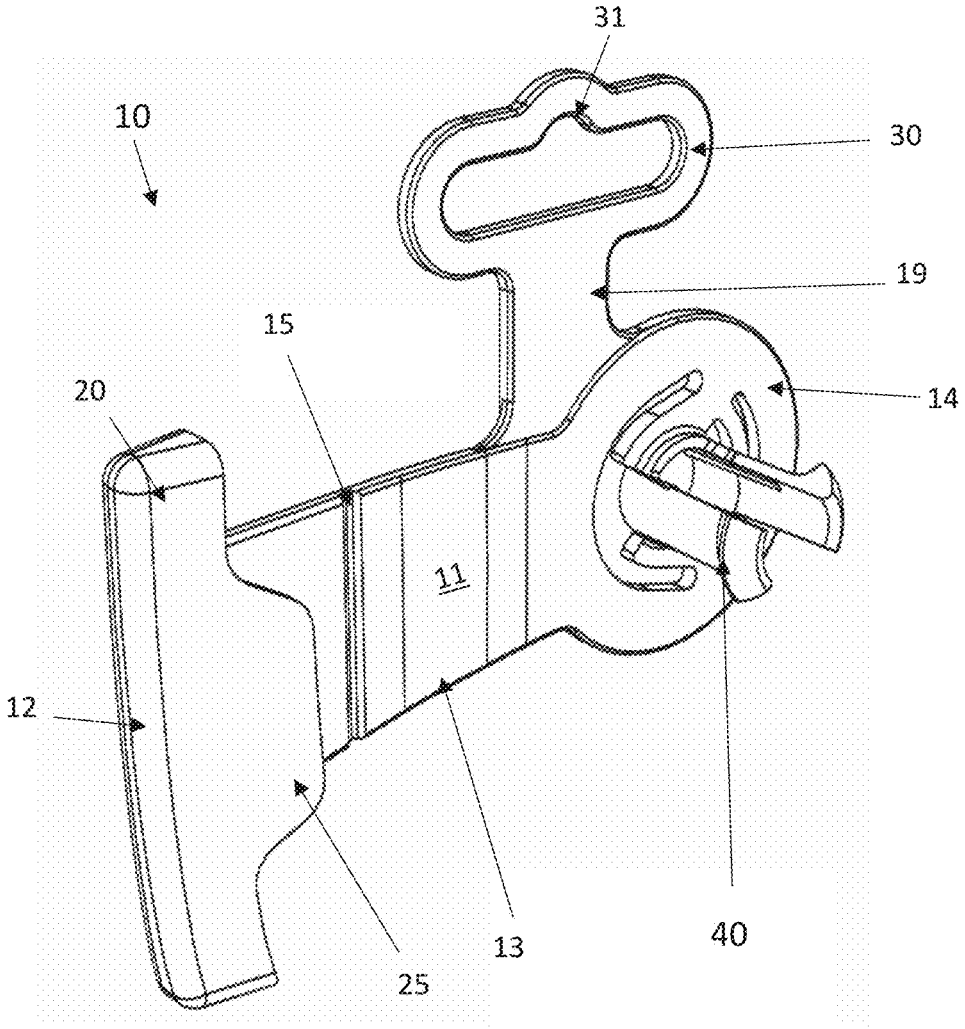
FIG. 4 refers to a left front top perspective view of the embodiment of the safety protective cover of FIG. 1.

The present invention will be described herein in accordance with a preferred embodiment that constitutes safety protective cover for cutting tool head, as will be explained below.

FIGS. 1 to 4 illustrate the preferred embodiment of the safety protective cover for cutting tool head of the present invention. As it can be seen, the protective cover 10 has a main body 11, divided into a front portion 12, a middle portion 13 and a rear portion 14. The main body 11 is substantially rectangular elongated plate shaped and it is preferably manufactured of a plastic material. The main body 11 further has a hinge 15 comprised by a slot of the same plastic material, which allows the movement of one degree of freedom between the front portion 12 and the middle portion 13 of the body 11.

On its part, the front portion 12 is comprised by the main body 11 extending in its width to form a substantially parallelepiped shaped protective housing 20 comprised by four walls 21, 22, 23, 24 as seen in FIG. 1. Preferably, the front wall 23 of the protective housing 20 also has a flange 25, substantially of a width that is similar to that of the main body 11.

Moreover, the middle portion 13 is substantially rectangular shaped and the rear portion 14 is substantially circular shaped. On the transition from the middle portion 13 and the rear portion 14, the body 11 also has a top projection 19 that is substantially rectangular elongated plate shaped. In the preferred embodiment, the end of the top projection 19 is capped by a hook 30 with a width that is greater than that of the projection, with a substantially elliptical ring shape. The hook 30 has a slot 31 in the middle part thereof. The slot 31 is arranged to receive fastening elements from a commercial display.

Finally, in the rear portion 14 of the main body 11, there is provided a locking mechanism 40 comprised by several technical elements extending perpendicularly to the surface of the main body 11 and which are to be described in greater detail below.

Figure 5A:
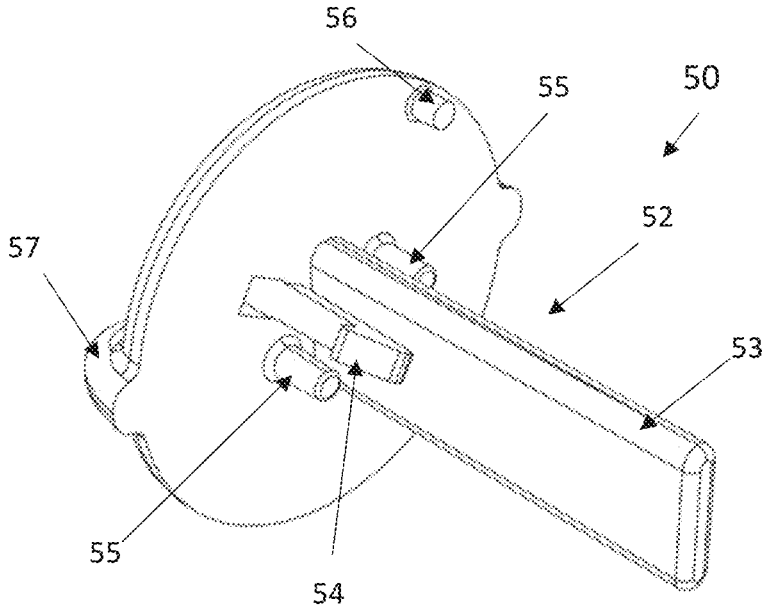
FIG. 5A refers to a front top perspective view of the snapping key used together with the safety protective cover.
Figure 5B:
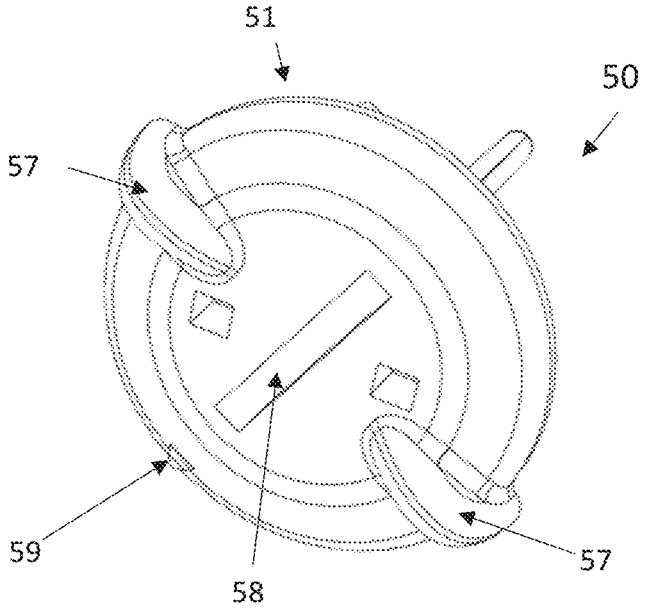
FIG. 5B relates to a rear top perspective view of the snapping key.
Figure 5C:
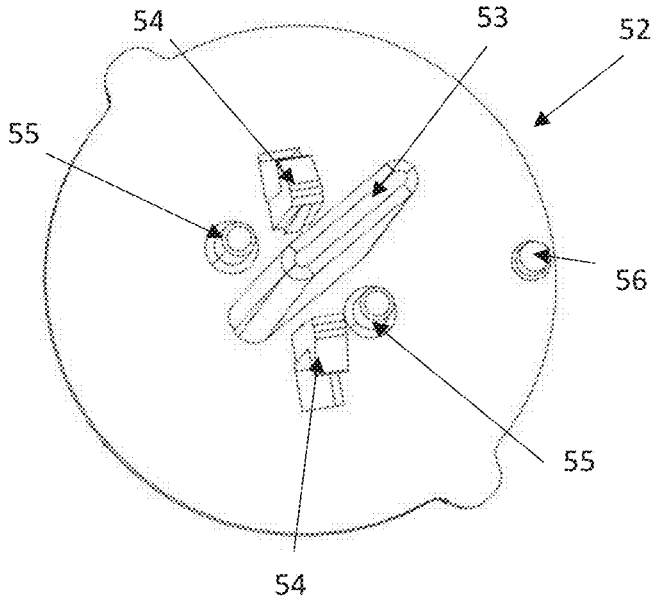
FIG. 5C refers to a front view of the snapping key.
Figure 5D:
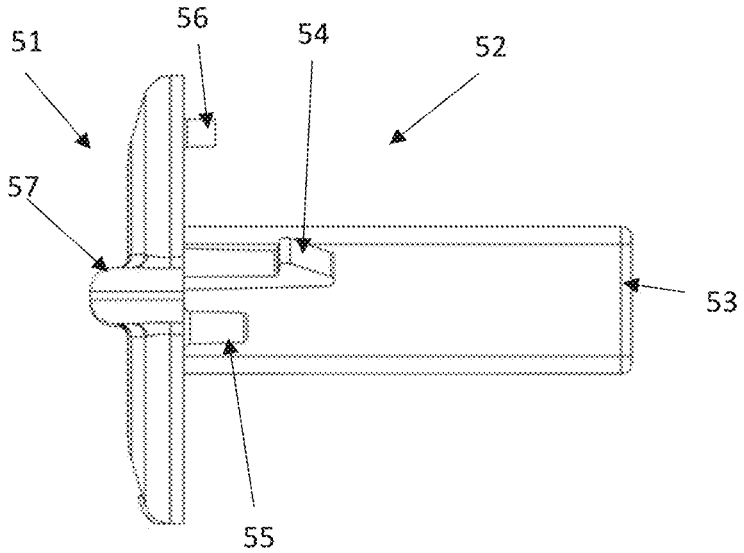
FIG. 5D refers to a side view of the snapping key.

Attending FIGS. 5A to 5D, a snapping key 50 can be seen, which is comprised by a grip portion 51 and a locking portion 52. The locking portion 52 has a latch 53 protruding with respect to the bottom face of the grip portion. The latch 53 has a substantially rectangular flat shape. In the preferred embodiment, the locking portion 52 also has two or more coupling tabs 54 and two or more guide pins 55. In the preferred embodiment, the coupling tabs 54 and the guide pins 55 are equidistant from the center of the grip portion 51 and are formed symmetrically. Preferably, the coupling tabs 54 have a bracing on the rear face thereof which provides flexibility and strength during operation, said bracing is best seen in FIG. 5C. Also, the locking portion 52 further has a stop pin 56. In the preferred embodiment, the stop pin is located eccentric and further away from the center of the grip portion 51. Moreover, the grip portion 51, on its top face, has two or more gripping walls 57 and placed perpendicularly on the periphery of the grip portion 51. In a preferred embodiment, the walls 57 can be placed in a defined angular arrangement with respect to the center of the grip portion. Also, the grip portion 51 further has a slot 58. In a preferred embodiment, the slot 58 is linear and passes through the center of the grip portion 51. Finally, the grip portion may have a targeting signal 59.

However, attending FIGS. 6A, 6B, 7A and 7B,it may be seen, in detail, the locking mechanism 40 of the protective cover object of the present invention. The locking mechanism 40 has at least two locking arms 42, 43. Each locking arm is capped at its end by a notch 44, 45 extending outwardly away from the other arm.

The locking mechanism 40 also has openings made to the material of the main body 11 a first side opening 41A, a second side opening 41B, a stop opening 41C and a central opening 41D. Preferably, the openings 41A to 41D were made to the material of the main body 11. In a preferred embodiment, the first side opening 41A has a "C" shape extending towards the top and bottom of the locking mechanism 40 and continues to the outer face of the base of the locking arm 42. In a preferred embodiment, the second side opening 41B has a substantially radial shape to the center of the locking mechanism 40 and continues to the outer face of the base of the locking arm 43. In a preferred embodiment, the stop opening 41C has an inverted "C" shape, substantially shorter in length than the side opening 41A and is also radial to the center of the locking mechanism 40. In a preferred embodiment, the central opening 41D is circular to the center of the locking mechanism 40.

Additionally, in the preferred embodiment, each arm comprises at least one rib 46, 47 on the inner surface of the arms 42, 43, respectively. Similarly, the locking mechanism 40 comprises at the least one rim 48, 49 on the inner surface of the central opening 41D, respectively. In a preferred embodiment, both the ribs 46, 47 and the rims 48, 49 are located in a given angular position for the proper interaction with the elements of the snapping key 50 as described below.

The operation of the safety protective cover for cutting tool head will now be explained attending FIGS. 4A to 9, wherein a cutting tool head 60 is placed on the surface of the main body 11 of the safety protective cover 10, aiming for the protective housing 20 to receive therein the sharp edge of the cutting tool. This maneuver is eased due to the rotation of the hinge 15. Once the sharp edge placed inside the protective housing 20, the hinge 15 is flexed to align the main body 11 and insert the locking arms 42, 43 inside a hole in the cutting tool. The locking arms 42, 43 are inserted until the notches 44, 45 exit at the other end of the hole in the tool making a clicking sound, as illustrated in FIG. 8.

Figure 6A:
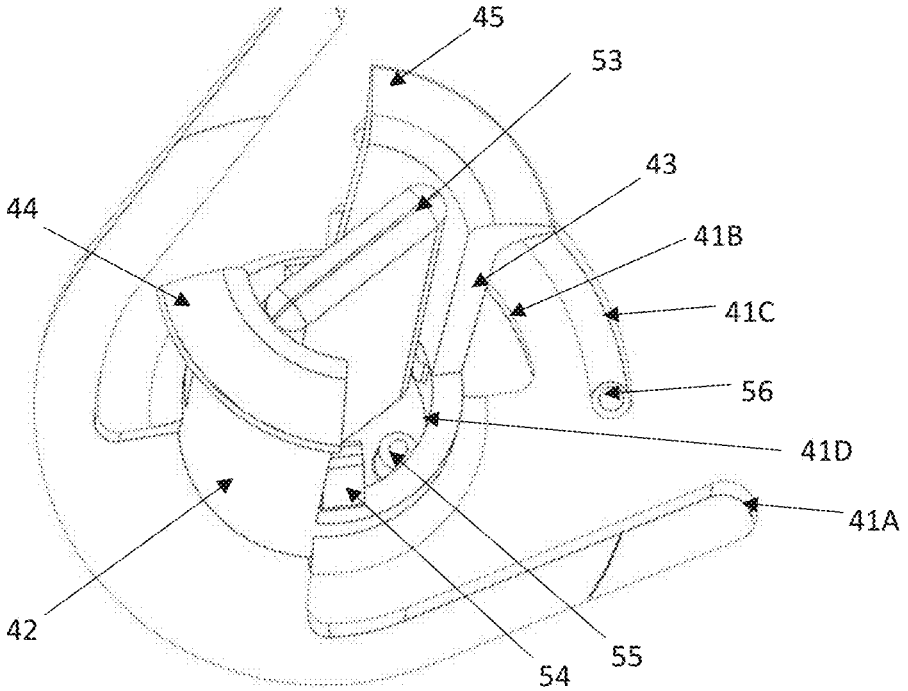
FIG. 6A refers to a detail perspective view of the interaction between the safety protective cover and snapping key in a locked position.
Figure 6B:
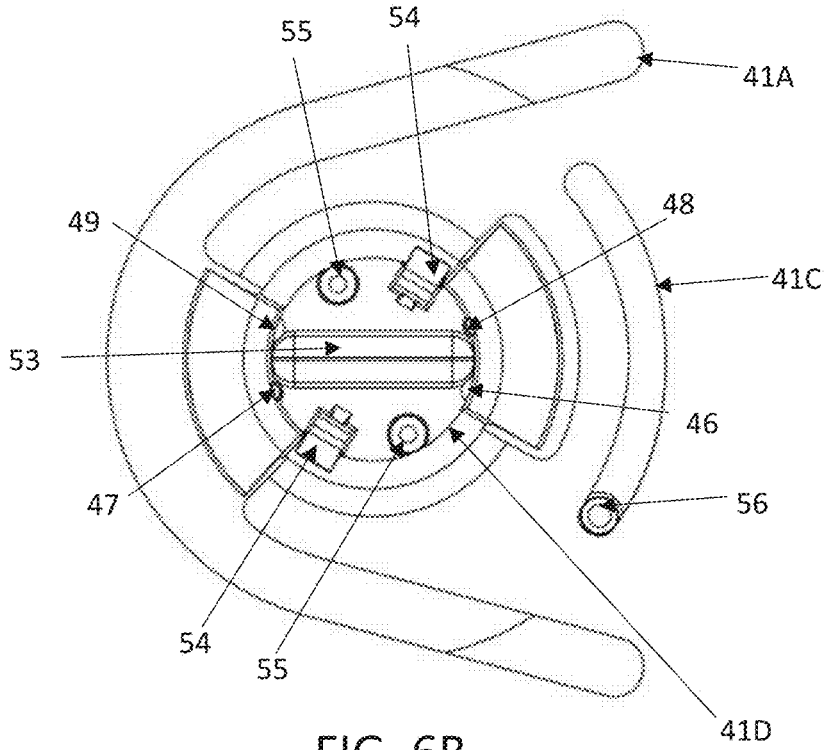
FIG. 6B refers to a detail front view of the interaction between the safety protective cover and snapping key in a locked position.
Figure 7A:
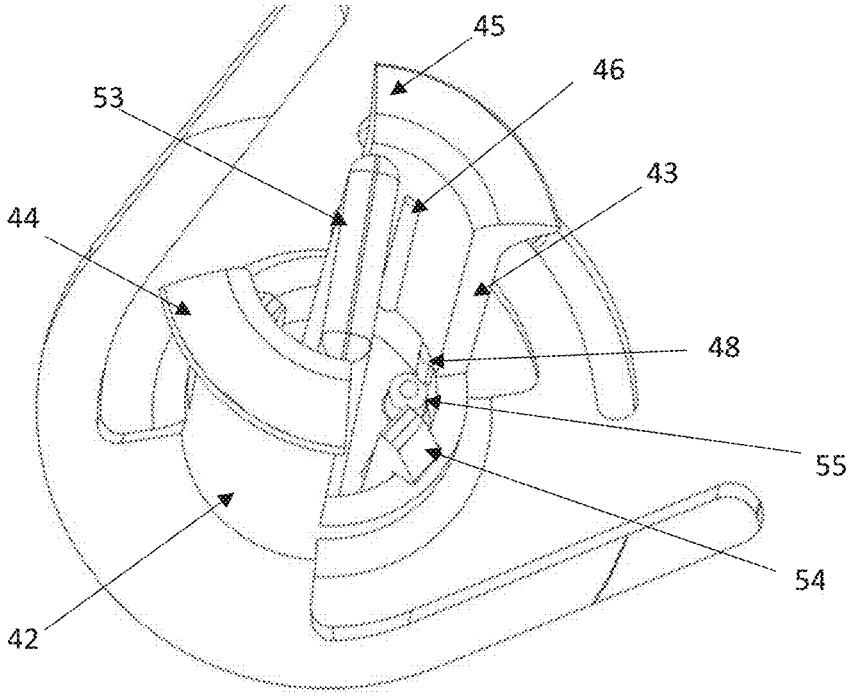
FIG. 7A refers to a detail perspective view of the interaction between the safety protective cover and snapping key in a released position.
Figure 8:
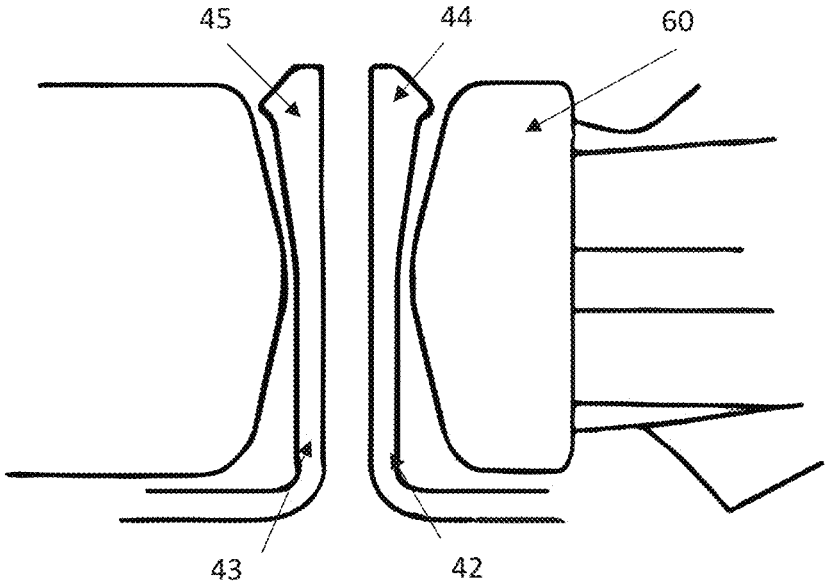
FIG. 8 refers to a sectional view of a portion of the safety protective cover of FIG. 1, as it passes through a hole in the head of the cutting tool.

Once the arms 42, 43 are placed in the locked position, the snapping key 50 housed in the central opening 41D at the inside of the arms 42, 43 is rotated, crossing from the main body 11 until before the latch 53 reaches the notches 44, 45, as illustrated in the views of FIGS. 6A and 7A. During the insertion of the snapping key 50, which can be in the assembling stage, the coupling tabs 54 are placed on the surface of the central opening 41D making a clicking sound, while the guide pins 55 are aligned to the inner wall of the central opening 41D. In a matching manner, the stop pin 56 is inserted into the stop opening 41C such that the stop pin 56 is aligned to the inner wall of said stop opening 41C. If inserted correctly, the locking mechanism 40 and the snapping key 50 will remain in the position illustrated in FIGS. 6A and 6B, wherein the stop pin 56 is located at the bottom of the stop opening 41C.

To complete the locking, the snapping key 50 is rotated from the grip portion 51 shown in FIG. 6B until it reaches the locked position shown in FIGS. 6A and 6B wherein the stop pin 56 is located at the top of the stop opening 41C. During this operation, the side walls of the latch 53 will slide over the ribs 46, 47 and stop at the rims 48, 49. In conclusion, in the locked position of FIGS. 6A and 6B, the latch 53 It housed between the ribs 46, 47 and the rims 48, 49 respectively in each arm; while in the released position of FIGS. 7A and 7B, the guide pins 55 are housed between the ribs 46, 47 and the rims 48, 49 respectively in each arm. Preferably, the rotation of the snapping key 50 substantially corresponds to 75° degrees from its open position to the closed position.

Once the tool is locked, the cover can be hung together with the cutting tool by means of the hook 30 in a store display. The sharp edge of the tool is protected inside the protective housing 20. Finally, the slot 58 can allow the user to use a coin or flat tool to engage it in the slot 58 to provide greater torque to the snapping key 50 when same rotated if required.

Figure 7B:
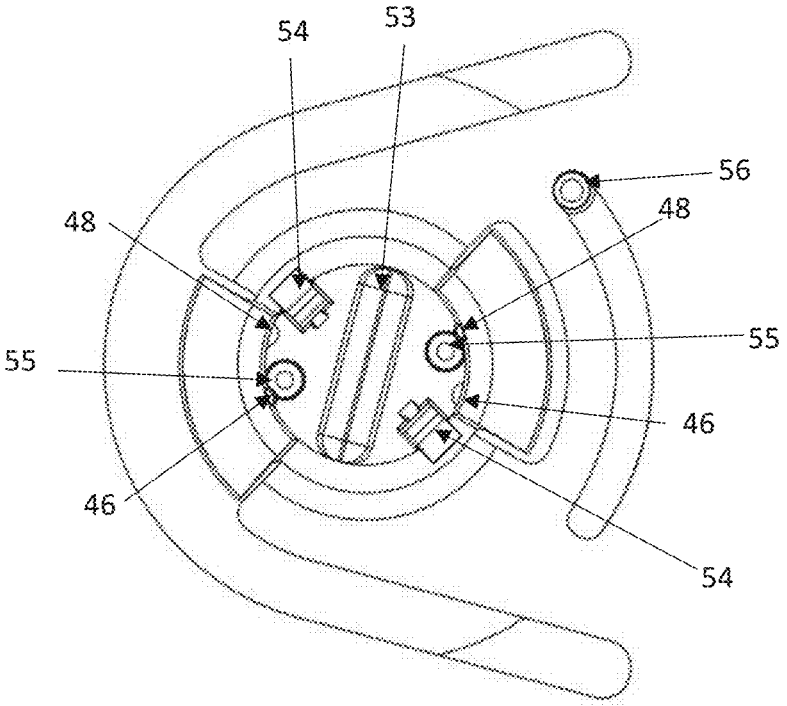
FIG. 7B refers to a detail front view of the interaction between the safety protective cover and snapping key in a released position.
Figure 9:
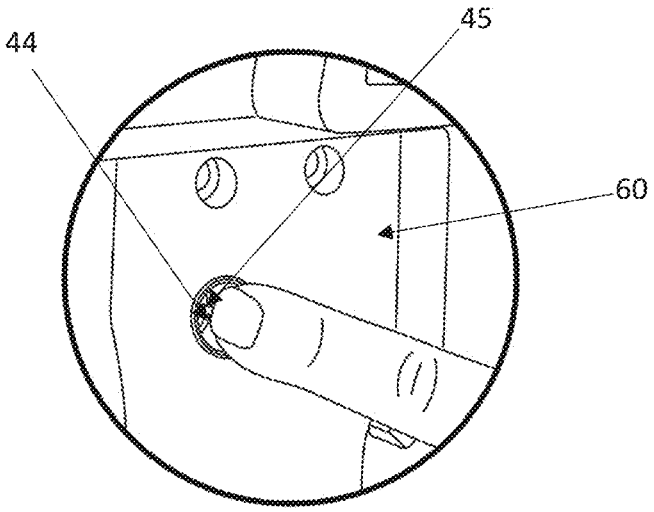
FIG. 9 refers to a perspective view of the safety protective cover illustrated in FIG. 8, wherein a user disengages the safety cover protective and the cutting tool head.
Figure 10:
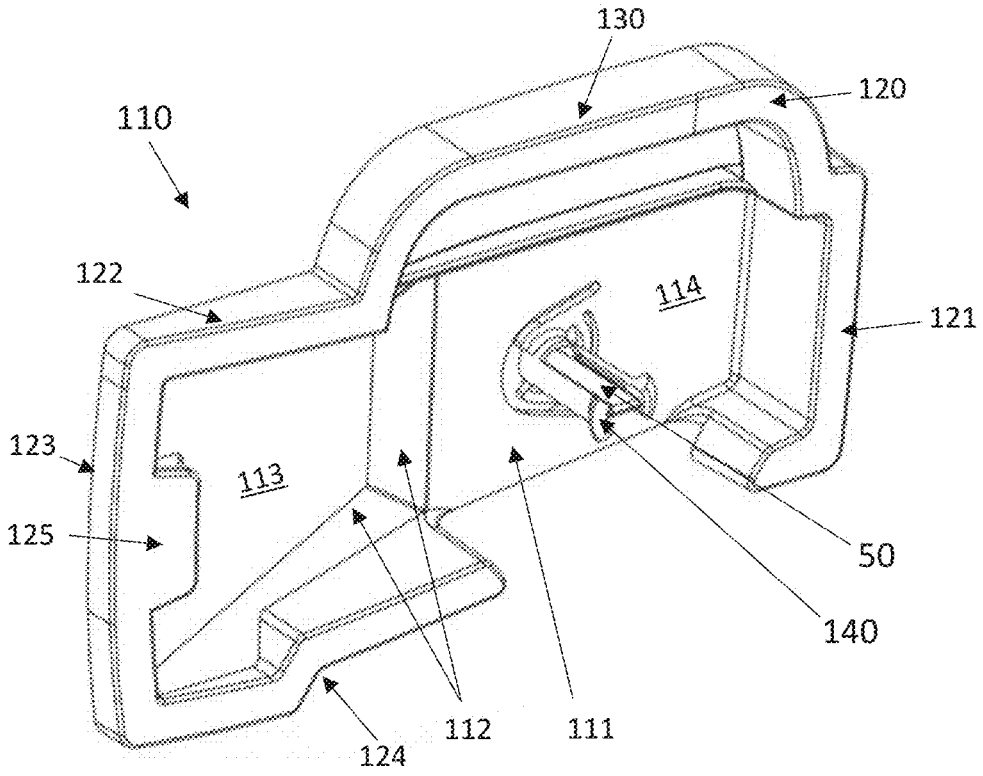
FIG. 10 refers to a left front top perspective view of a second embodiment of the safety protective cover for cutting tool head object of the present invention.
Figure 11:
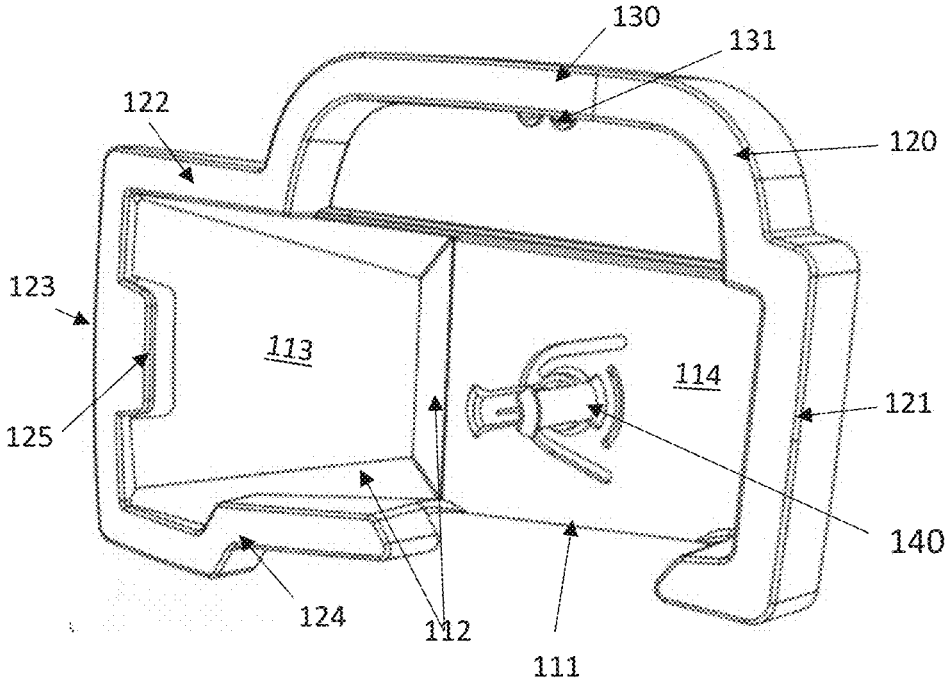
FIG. 11 refers to a front view of the embodiment of the safety protective cover of FIG. 10.
Figure 12:
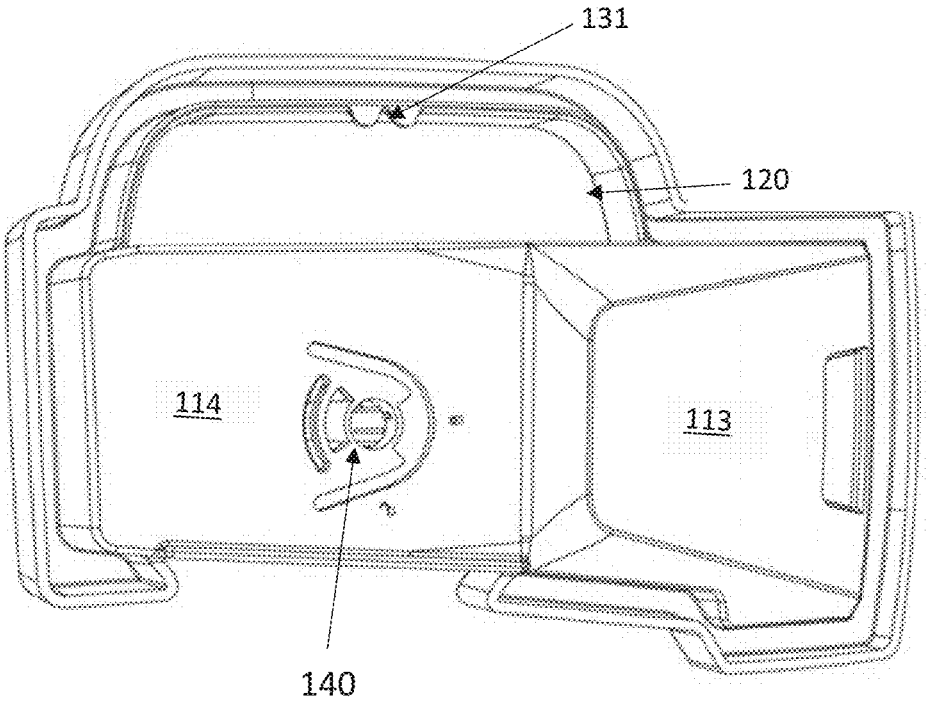
FIG. 12 refers to a rear view of the embodiment of the safety protective cover of FIG. 10.

To release the cutting tool 60 of the safety protective cover 10, the snapping key 50 shall be rotated from the grip portion 51 thereof, from the locked position of FIGS. 6A and 6B to the released position of FIGS. 7A and 7B. Subsequently, the snapping key is removed 50 and the arms 42, 43 are released from the locking mechanism 40 by inserting the user's finger, as illustrated in FIG. 9. Finally, the flange 25 is used to pull the sharp edge of the cutting tool 60 outwards of the protective housing 20.

The second embodiment of the safety protective cover for cutting tool head, which can be preferably used for larger-sized cutting tools, is illustrated in FIGS. 10 to 13, wherein the protective cover 110 has a main body 111. The main body 111 is substantially rectangular elongated plate shaped and is manufactured in a similar way to that of the first embodiment of a plastic material. The main body 111 is enclosed by a frame 120. The main body 111 has a housing portion 112 and a locking portion 114.

The housing portion 113 112 describes a shape 113 that matches the shape of the cutting tool head sought for protection. Meanwhile, in the locking portion 114, a locking mechanism 140 is located. The locking mechanism 140 exactly matches the same locking mechanism 40 that has been described in previous paragraphs.

The frame 120 is comprised of a rear portion 121, a top portion 122, a front portion 123 and a bottom portion 124. Note that the bottom portion 124 of the frame 120 does not enclose the entirety of the main body 111 as the missing space allows the passage of the handle of the cutting tool. The top portion 122 of the frame 120 has a handle 130 with functions facilitating transportation by way of providing a hand grip, and also facilitate the display in a manner similar to the hook of the first embodiment. In the preferred embodiment, the handle 130 has a holding projection 131 in the middle part thereof, which is arranged to receive fastening elements from a commercial display. The front portion 123 of the frame 120 further has a flange 125. The second embodiment likewise provides the use of the snapping key 50 as illustrated and described in the first embodiment.

Figure 13:
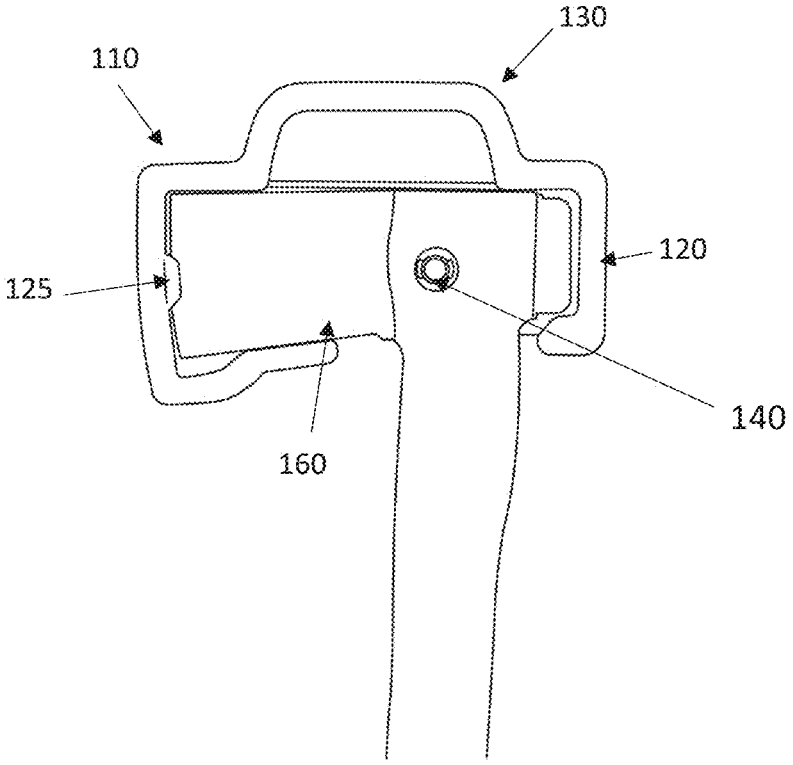
FIG. 13 refers to a front view of the safety protective cover of FIG. 10, placed above a cutting tool head.

The operation of the second embodiment of the safety protective cover for cutting tool head will now be explained attending FIG. 13, wherein a cutting tool head 160 is placed on the surface of the main body 111 of the safety protective cover 110, aiming for the profile 113 to receive an area of the tool head and the sharped edge to be placed to the inside of the flange 125 and the front portion of the frame 123. Also, the locking mechanism 140 shall be inserted in the same manner as in the first embodiment, as illustrated in FIG. 8.

To release the cutting tool 160 of the safety protective cover 110, the locking mechanism 140 is released in the same way as the first embodiment, made to be used by smaller cutting tools. Finally, the flange 125 functions as a guide when the cutting tool head is inserted or removed from 113.

Based on the above disclosure, certain embodiments and details have been described in order to illustrate the present invention, and it will be apparent to those skilled in the art that variations and modifications may be made without departing from the scope of the present invention.

The invention claimed is:

1. A safety protective cover for cutting tool head comprising: a front portion, a middle portion and a rear portion wherein the cover is divided into the front portion, the middle portion and the rear portion, wherein the front portion has a protective housing fitted to receive a sharp of the cutting tool; and the rear portion having a lock sized to fit inside a hole of the cutting tool:

the lock having at least two locking arms capped at their end by a notch extending outwardly away from the other arm, and each arm comprises at least one rib on the inner surface thereof; and, further, the lock having a first side opening, a second side opening, a stop opening and a central opening; and further comprises at least one rim on the inner surface of the central opening;

the notches of the arms protrudes out of the hole of the tool when in place, and a snapping key is inserted through the central opening to the inside of the arms crossing from the cover to before reaching the notches;

said snapping key is divided into a grip portion and a locking portion, wherein the locking portion has a protruding latch with respect to the bottom face of the grip portion; and the locking portion further has two or more coupling tabs, two or more guide pins and a stop pin;

both the ribs of the arms and the rims in the central opening are located in a given angular position for the correct interaction with the snapping key;

the coupling tabs are placed on the surface of the central opening, while the guide pins are aligned to the inner wall of the central opening, also, the stop pin is inserted into the stop opening such that the stop pin is aligned to the inner wall of said stop opening; and the snapping key can rotate from a locked position to a released position and vice versa.

2. The safety protective cover of claim 1, wherein the cover is substantially rectangular elongated plate-shaped and is manufactured of a plastic material; and it further has a hinge comprised by a slot of the same plastic material which allows a movement of one degree of freedom between the front portion and the middle portion.

3. The safety protective cover of claim 1, wherein the protective housing comprised by four walls, wherein a front wall thereof further has a flange.

4. The safety protective cover of claim 1, wherein between the middle portion and the rear portion, the cover further has a top projection, wherein the end of the top projection is capped by a hook, with a width that is greater than the projection, with a substantially elliptical ring shape.

5. The safety protective cover of claim 1, wherein the coupling tabs and the guide pins are equidistant to the center of the grip portion and are symmetrically formed, and, further, the coupling tabs have a bracing on the rear face thereof; and, further, the stop pin is located eccentric and further away from the center of the grip portion.

6. The safety protective cover of claim 1, wherein the grip portion, on its top face, has two or more gripping walls placed perpendicularly and in the periphery of the grip portion, and has a slot that is linear and passes through the center of the grip portion, and further has a targeting signal.

7. The safety protective cover of claim 1, wherein:

the first side opening has a "C" shape extending towards the top and bottom of the lock and continues to the outer face of the base of the locking arm;

the second side opening has a substantially radial shape to the center of the lock and continues to the outer face of the base of the locking arm;

the stop opening has an inverted "C" shape, substantially shorter in length than the side opening and is also radial to the center of the lock; and the central opening is circular to the center of the lock.

8. The safety protective cover of claim 1, wherein the cover is substantially rectangular elongated plate shaped and is manufactured of a plastic material; further, the cover is enclosed by a frame; and, further, the cover has a shape matching the shape of the cutting tool head.

9. The safety protective cover of claim 8, wherein the frame is comprised by a rear portion, a top portion, a front portion and a bottom portion; wherein the bottom portion of the frame does not enclose the entirety of the cover to allow the passage of the handle of the cutting tool; and, further, the top portion of the frame has a handle.

* * * * *